United States Patent [19]

Simmons

[11] Patent Number: 5,016,618

[45] Date of Patent: May 21, 1991

[54] METHOD AND APPARATUS FOR MASSAGE

[76] Inventor: Thomas R. Simmons, 3510 Lobit, Dickinson, Tex. 77539

[21] Appl. No.: 235,206

[22] Filed: Aug. 23, 1988

[51] Int. Cl.[5] ..... A61H 9/00

[52] U.S. Cl. ..... 128/66; 128/33; 128/64

[58] Field of Search ..... 128/66, 33, 34, 38, 128/64

[56] References Cited

U.S. PATENT DOCUMENTS

| | | | |
|---|---|---|---|
| 1,716,109 | 6/1929 | Bruggmann | 128/66 |
| 1,896,938 | 2/1933 | Borowsky | 4/543 |
| 1,982,258 | 11/1934 | Martin | 128/66 |
| 1,982,260 | 11/1934 | Martin | 128/66 |
| 1,982,261 | 11/1934 | Martin | 128/66 |
| 2,738,787 | 3/1956 | Jacuzzi | 128/66 |
| 2,870,456 | 1/1959 | Greensides | 128/66 |
| 3,281,864 | 11/1966 | Linnehan | 128/366 |
| 3,396,722 | 8/1968 | Lindberg | 128/66 |
| 3,477,424 | 11/1969 | Tracy | 128/66 |
| 3,809,073 | 5/1974 | Baumann | 4/542 |
| 3,952,736 | 4/1976 | Moret et al. | 128/66 |
| 4,010,498 | 3/1977 | Jablonski | 128/66 |
| 4,168,705 | 9/1979 | Raab | 128/66 |
| 4,177,927 | 12/1979 | Simmons | 4/615 |
| 4,192,297 | 3/1980 | Labreeque | 128/66 |
| 4,218,784 | 8/1980 | Richards | 4/543 |
| 4,225,984 | 10/1980 | Lindsey | 128/66 |
| 4,275,713 | 6/1981 | Tellander et al. | 128/66 |
| 4,282,866 | 8/1981 | Miffitt | 4/541 |
| 4,535,490 | 8/1985 | Wright | 4/542 |
| 4,635,620 | 1/1987 | Richio | 128/64 |
| 4,757,562 | 7/1988 | Mützell | 128/66 |

*Primary Examiner*—Edgar S. Burr
*Assistant Examiner*—E. P. Raciti

[57] ABSTRACT

Method and apparatus are provided for employing intermittently pulsating or arcuately moving pressured streams of water for massage purposes. A pallet-like structure and the like is provided with a relatively thin sheet-like material on its topside, and a plurality of conduits and nozzles are disposed below to direct pulsating or arcuately oscillating jets of water upwardly against the underside of the sheet-like material.

9 Claims, 5 Drawing Sheets

FIG. 1
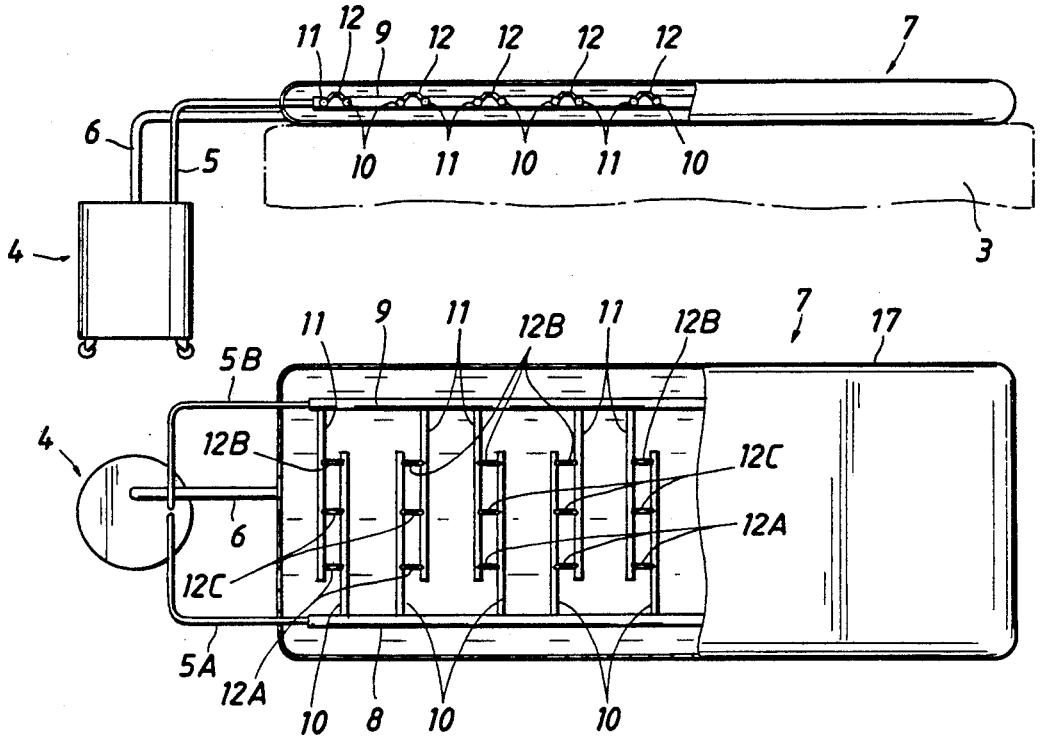
FIG. 2
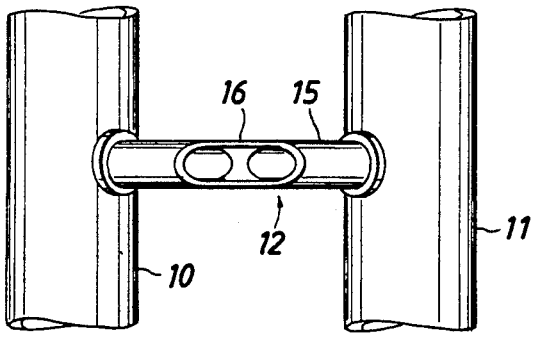
FIG. 4
FIG. 5
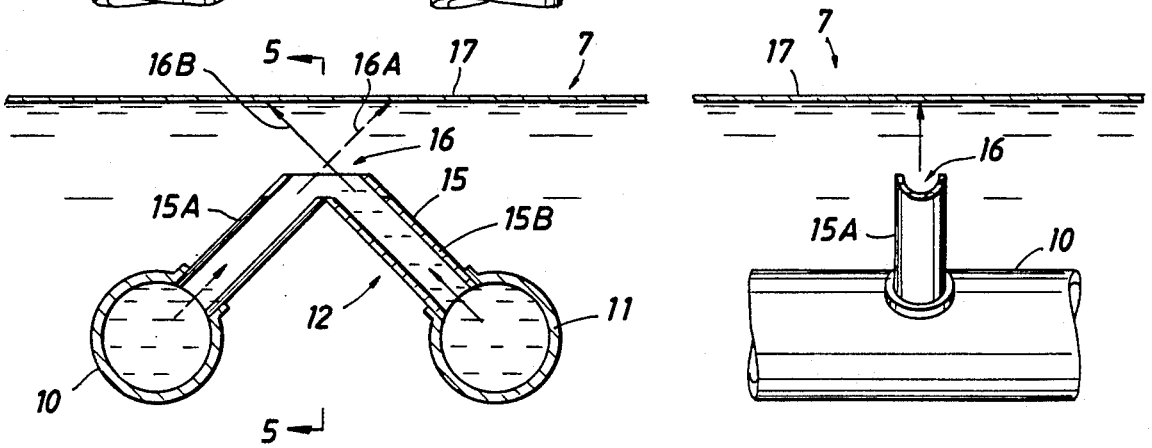
FIG. 3

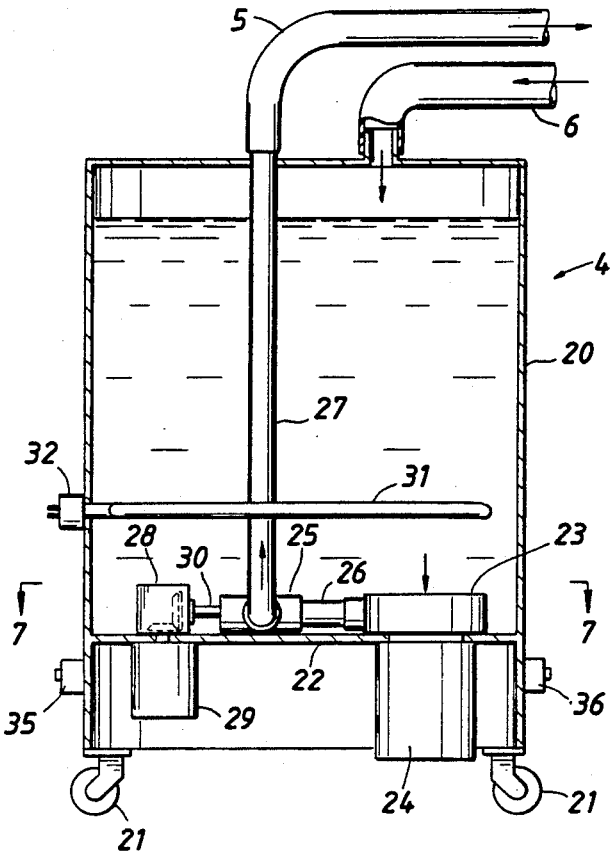
FIG.6
FIG.7
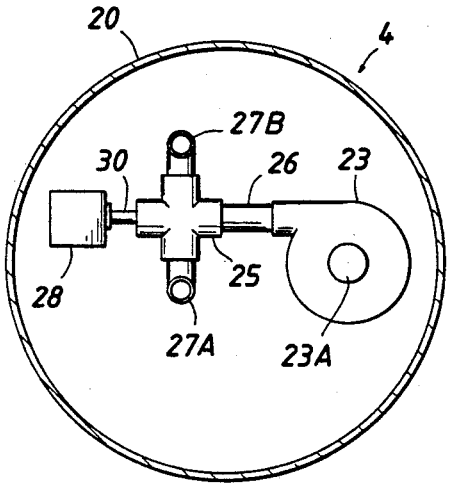
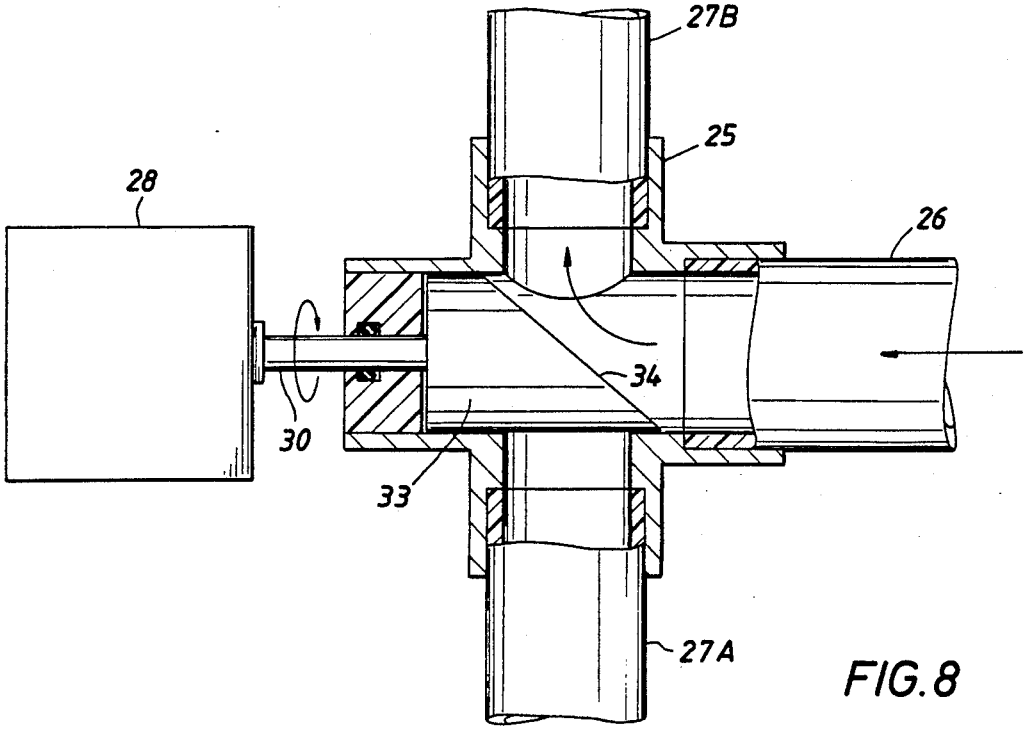
FIG.8

FIG. 9
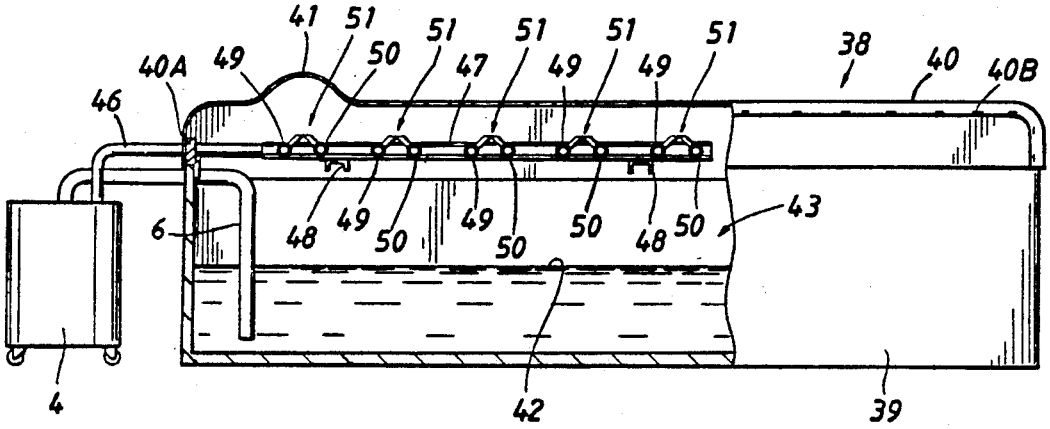
FIG. 10
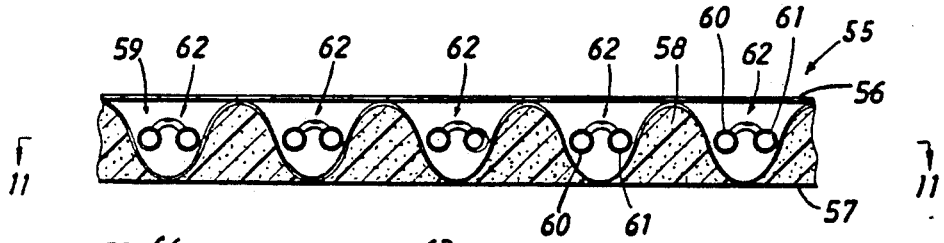
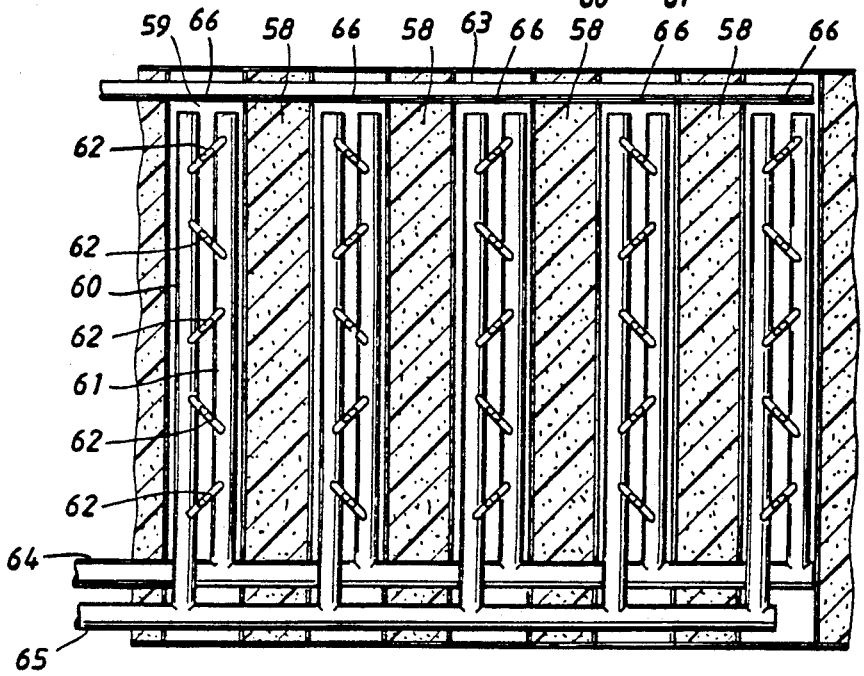
FIG. 11

FIG. 12
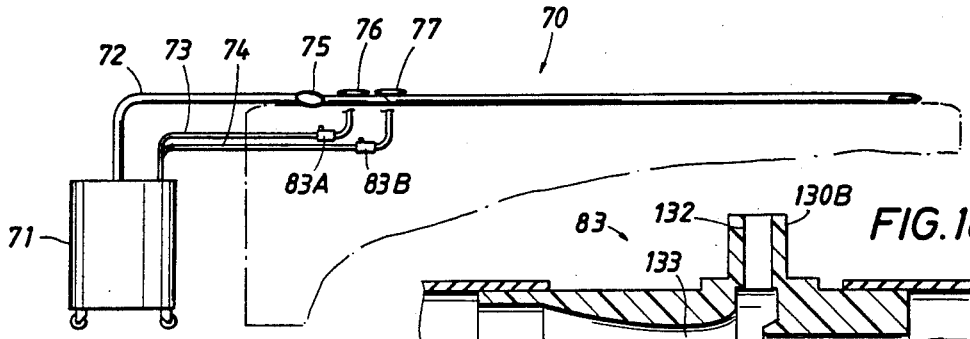
FIG. 18
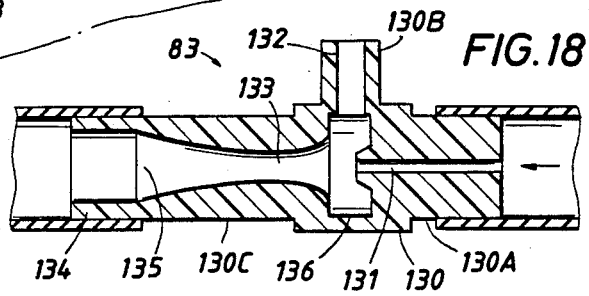
FIG. 13
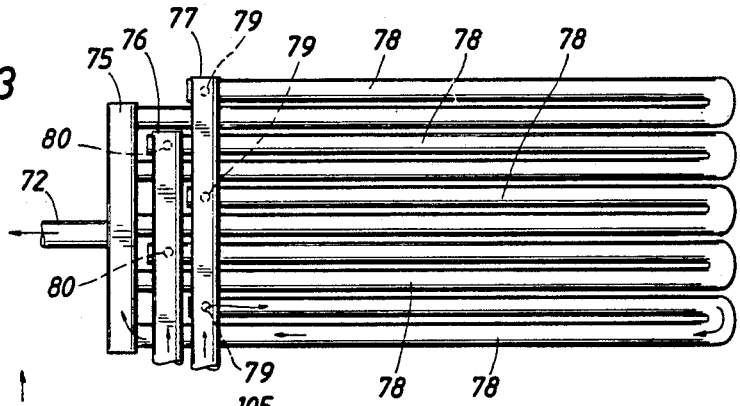
FIG. 14
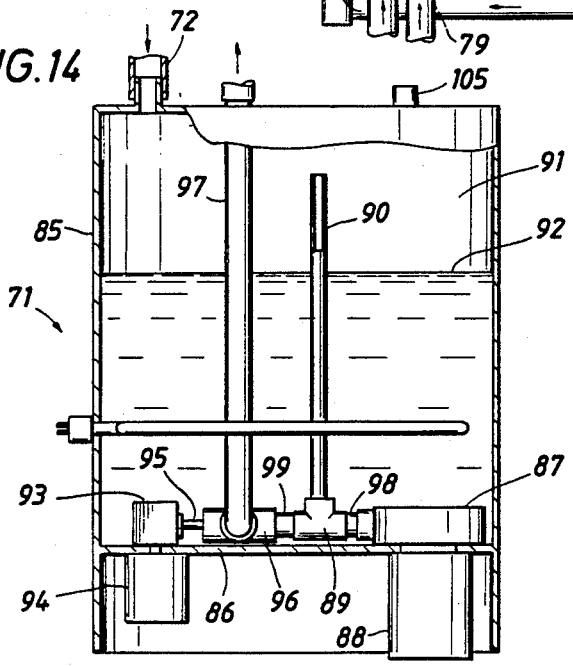
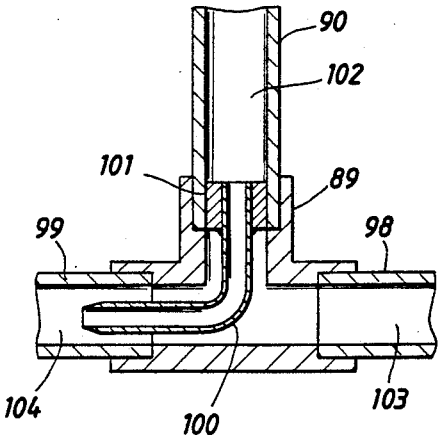
FIG. 15

METHOD AND APPARATUS FOR MASSAGE

BACKGROUND OF THE INVENTION

This invention relates to improved massage methods and apparatus, and more particularly relates to improved methods and apparatus for applying massage to a person in a prone position.

The physical and therapeutic benefits of massage are well known and do not require explanation. It is well known, however, that the most theraputic massage is delivered "head-to-toe" by a skilled masseur while the subject is in a prone position. There are many persons, such as those afflicted with arthritis, who repeatedly need such treatment on a frequent basis. The services of a professional masseur are relatively expensive, and only a fortunate few can afford the benefit of retaining a masseur on a full-time basis.

For this reason, many different types of massage devices have been proposed whereby the subject can receive a full "head-to-toe" massage without a masseur. Unfortunately, none of the various devices heretofore proposed have ever been capable of delivering a massage as effectively as that provided by a masseur. Those massage devices which have been capable of performing in a reasonably beneficial manner, have usually been extremely elaborate and complicated, and have therefore been expensive to both purchase and maintain. Furthermore, such a massaging device has also been difficult if not impossible for the user to operate without assistance.

Many different massage devices have, of course, been proposed and provided which are simpler and therefore cheaper to purchase and maintain. However, all such devices have only been useful in massaging a limited portion of the body, and have never been capable of providing the type of "head-to-toe" massage which is often needed for therapeutic purposes.

These disadvantages and limitations of the prior art are overcome with the present invention and improved massage methods and apparatus are provided which are capable of delivering a complete "head-to-toe" massage to a subject lying in a prone position.

SUMMARY OF INVENTION

As hereinbefore indicated, the subject is preferably in a prone position when receiving a complete "head-to-toe", and therefore a preferred form of the present invention will include a yieldable pallet-like device, which may be mounted on any convenient platform or other structure, and which is adapted to support the subject in a reclining or prone position. The pallet is preferably formed to contain water or the like, as well as an assembly of conduits and nozzles for generating streams of water against the upper portion of the pallet.

In this embodiment of the present invention, the overall assembly also includes a reservoir and pumping device, which is suitably interconnected with the pallet by a plurality of flexible conduits or hoses. Referring in particular to the reservoir and pumping device or assembly, this portion of the overall assembly is preferably composed of a canister for containing a supply of water, and a pump for transferring water from the canister to the assembly of conduits and nozzles located within the water-filled pallet, by way of a pair of hoses extending between the canister and the pallet. In addition, a motor-driven alternating valve is also included within the canister, for alternatively connecting the pump to one hose and disconnecting it from the other. In addition, a third hose is also preferably interconnected between the pallet and the canister for serving as a return for water flowing from the pallet back to the canister.

Referring again to the array of conduits and nozzles enclosed in the pallet, there is preferably provided a pair of longitudinal conduits, which are each located along the length and adjacent each side of the pallet, and which are each interconnected with a different one of the delivery hoses through which water is pumped from the canister into the pallet. In other words, when the alternating valve in the canister interconnects the pump with one of the two delivery hoses leading to the pallet, water will flow into one of the two longitudinal conduits therein. When the valve shifts to interconnect the pump with the other delivery hose, water will flow from the canister to the other conduit in the pallet.

Referring again to the conduits in the pallet, each conduit is also provided with a plurality of secondary lines extending laterally across the interior of the pallet. In addition, each secondary line from one of the two longitudinal conduits is located adjacent and in alignment with a secondary line from the other longitudinal conduit in the pallet, and each of these pairs of secondary lines is interconnected with a plurality of nozzles each adapted to emit an upwardly directed and arcuately moving stream of water, in functional response to the operation of the pump and alternating valve in the canister.

The pallet is preferably a sealed bag-like device composed of a flexible and impermeable material to hold the water without leakage or spillage. Because of the flexible character of this material, the subject will clearly feel the effect of these arcuately moving streams of water and whereby he receives the massage sought to be produced with this embodiment of the present invention.

Accordingly, it is an object of the present invention to provide improved methods and means for delivering a "head-to-toe" massage to a reclining subject.

It is further an object of the present invention to provide improved methods and means for delivering a massage by means of moving streams within a water-filled pallet and the like.

It is a specific object of the present invention to provide improved apparatus for massaging a person, comprising reservoir means for containing a quantity of water and the like, pumping means interconnected with said reservoir means for generating cyclically intermittent pressured flows of water at a plurality of different spaced-apart locations, and massaging means interconnected with said pumping means for receiving and yieldably containing said pressured flows of water adjacent said plurality of different locations.

It is another specific object of the present invention to provide an improved method for massaging a person and the like, comprising generating a pressured stream of water, diverting said pressured stream of water cyclically and intermittently along a first route to a plurality of preselected locations adjacent said person, diverting said pressured stream of water cyclically and intermittently along a second different route to a plurality of preselected locations adjacent said person, and generating a pulsating discharge of pressured water at each of said locations as a function of said cyclic diversion of said streams along said first and second routes.

These and other objects and features of the present invention will become apparent from the following detailed description, wherein reference is made to the structures depicted in the accompanying drawings.

IN THE DRAWINGS

FIG. 1 is a simplified pictorial representation, partly in cross section, of the basic components of a particularly suitable embodiment of the present invention.

FIG. 2 is a simplified pictorial representation, partly in cross section, of another different view of the apparatus depicted in FIG. 1.

FIG. 3 is a simplified pictorial representation, partly in cross section, of a particular portion of the structure depicted generally in FIGS. 1 and 2.

FIG. 4 is another different pictorial representation, partly in cross section, of the structures depicted in FIG. 3.

FIG. 5 is a further different pictorial representation of the structures depicted in FIGS. 3 and 4.

FIG. 6 is a more detailed representation, partly in cross section, of another different portion of the structures depicted generally in FIGS. 1 and 2.

FIG. 7 is another different representation of the structures depicted in FIG. 6.

FIG. 8 is a simplified pictorial representation, partly in cross section, of a particular portion of the structures depicted in FIGS. 6 and 7.

FIG. 9 is a simplified pictorial representation, partly in cross section, of the basic components of another different embodiment of the present invention.

FIG. 10 is a simplified pictorial representation, partly in cross section of a portion of the apparatus depicted in FIG. 9.

FIG. 11 is also a simplified pictorial representation, partly in cross section of another different view of the structures depicted in FIG. 9.

FIG. 12 is a simplifiied pictorial representation, partly in cross section, of a further different embodiment of the present invention.

FIG. 13 is a simplified pictorial representation of the apparatus depicted generally in FIG. 12.

FIG. 14 is a more detailed pictorial representation, partly in cross section, of a portion of the apparatus and structures depicted in FIG. 12.

FIG. 15 is a more detailed pictorial representation, partly in cross section, of a portion of the structures more generally depicted in FIG. 14.

FIG. 18 is a more detailed pictorial representation, partly in cross section, of a portion of the apparatus illustrated generally in FIG. 12.

DETAILED DESCRIPTION

Figure 16:
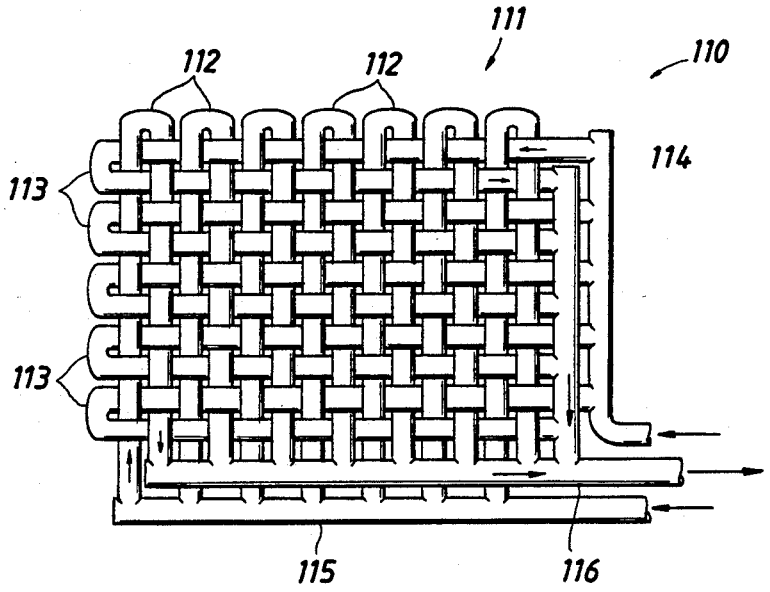
FIG. 16 is a detailed pictorial representation of an alternative form of the structures depicted in FIG. 13.

Referring now to FIG. 1, there will be seen a simplified pictorial representation of a particularly suitable embodiment of the present invention, wherein the depicted structure is a massage assembly composed of a pallet 7 disposed on a table 3 or other suitable support structure, and a reservoir and pumping unit 4 interconnected with the pallet 7 by a plurality of supply and return hoses 5 and 6. As may further be seen, the pallet 7 is a water-filled bag-like component containing a plurality of manifolds 8 and 9 interconnected by lateral lines 10 and 11, and further having a plurality of nozzles 12 arranged to direct individual pressured streams of water upwardly against the subject (not depicted) reclining on the pallet 7.

Referring now to FIG. 2, there may be seen a different view of the apparatus depicted generally in FIG. 1, and showing that the row of manifolds located within the pallet 7 include a plurality of longitudinal manifolds 8 and 9 each extending along the length of the pallet 7 and adjacent its opposite sides. More particularly, manifold 8 may be seen to be interconnected with the reservoir and pumping unit 4 by means of supply hose 5A, and manifold 9 may be seen to be interconnected with the same component by way of supply hose 5B. The pallet 7 is essentially a water-filled bag-like component formed of a flexible sheet-like material 17, and is interconnected with the reservoir and pumping unit 4 by means of a return line or hose 6.

Referring again to FIG. 2, manifold 8 may further be seen to be provided with a plurality of spaced-apart lateral lines 10 each extending towards but not to manifold 9 on the opposite side of the pallet 7. Alternatively, manifold 9 may be seen to be provided with a similar plurality of spaced-apart lateral lines 11 which, in turn, extend towards but not to manifold 8 on the opposite side of the pallet 7. As further depicted, each adjacent pair of lateral lines 10 and 11 may be seen to be interconnected with at least two nozzles 12A and B, which components are preferably formed in substantially the same manner as the corresponding components depicted and described in U.S. Pat. No. 4,177,927.

Referring again to the structures depicted in FIG. 2, it should be noted that the function of the reservoir and pumping unit 4 is to supply a flow of water into the pallet 7 for the purpose of completely filling that component, whenever the massage assembly 2 is intended to be operated. When the massage assembly 2 is deactivated, however, provision may be made to permit the water to drain out of the pallet 7 and back into the reservoir and pumping unit 4.

Referring further to the structures depicted in FIGS. 1 and 2, it will be noted that the additional purpose of the reservoir and pumping unit 4 is to alternately supply a pressured flow of water into first manifold 8 and then manifold 9. More particularly, when water is directed into manifold 8, the contents of manifold 9 will be closed to trap the water therein, whereby water will flow from manifold 8 into lateral lines 10 and the nozzles 12A–C interconnecting laterals 10 and 11. As hereinbefore noted, the water pressure in manifolds 8 and 9 will result in individual pressured streams of water being ejected from the nozzles 12 in an upward direction against the person reclining on the top of the pallet 7. The pallet 7, being composed of a relatively thin flexible sheet material 17, will cause the subject to be physically aware of these streams of water beating upwardly against the top portion of the pallet 7, whereby the reclining subject will experience the physical effects of the massage provided by these streams of water. As will be further explained, when the water pressure is being delivered through hose 5A to manifold 8, the upwardly directed streams will tend to move arcuately toward lateral lines 11, and when the pressured stream of water from the reservoir and pumping unit 4 is delivered through hose 5B to manifold 9, the upwardly directed streams will move arcuately in the opposite direction towards lateral line 10. As will hereinafter be explained in detail, the function of the reservoir and pumping unit 4 is to change or shift pressure between manifolds 8 and 9 many times during each minute, and therefore these upward streams from the nozzles 12 will move arcuately back and forth to further enhance the massaging effect sought to be achieved by the massage assembly 2 depicted in FIGS. 1 and 2.

Referring now to FIGS. 3-5, there may be seen a more detailed pictorial representation, partly in cross section, of the nozzle 12 which interconnects lateral lines 10 and 11 in the water-filled pallet 7. More particularly, the nozzle 12 may be seen to be composed of a tubular member 15 which is actually composed of a pair of tubes 15A-B each having one end interconnected with a respective one of lateral lines 10 and 11 and having their opposite ends angularly joining to provide an open port 16 for directing the streams of water upwardly against the flexible sheet-like material 17 forming the top portion of the pallet 7.

As will be more particularly described in U.S. Pat. No. 4,177,927, two or more streams or pressured flows of water and the like may be blended to produce a third stream flowing in a different direction. More particularly, the direction and flow rate of such third stream may conveniently be adjusted as desired, by selectively varying either the flow rate or pressure of one or both of the streams sought to be blended. As will hereinafter be explained in detail, in this embodiment of the present invention the output from the port 16 will be directed upwardly against the sheath 17 at an angle determined by the difference in flow rates or pressures in lines 10 and 11. If these flow rates are substantially equal, the output from the port 16 will be directed substantially perpendicularly against the sheath 17. If, however, the flow rate in line 10 is substantially greater than in line 11, the stream issuing from the port 16 will be directed substantially along the indicating arrow 16A. Alternatively, if the flow rate in line 11 is substantially greater than in line 10, the stream from port 16 will tend to be directed along the indicating arrow 16B.

As hereinbefore stated, the objective of the present invention is to provide the functional equivalent of a massage to a person who is resting on the sheath 17. Accordingly, if the flow rates in lines 10 and 11 are alternately increased and diminished in a cyclic repetitive manner, the output stream from port 16 will alternate arcuately between the two indicating arrows 16A-16B to achieve this beneficial effect.

Referring now to FIGS. 6 and 7, there may be seen two pictorial illustrations of the reservoir and pump assembly 4 depicted more generally in FIGS. 1 and 2, and whereby this portion of the massage assembly 2 may be seen to include a tank 20 which may be conveniently supported by a plurality of casters 21 and which is preferably designed to contain an appropriate quantity of water. More particularly, the tank 20 may be seen to have an internal shelf 22 for supporting a pump 23 and pump motor 24, and also a gearbox 28 which, in turn, is driven by a second motor 29. The pump has its output interconnected to a suitable alternating valve 25 by means of a conduit 26, for delivering water from the contents of the tank 20 to an appropriate conduit 27 which, in turn, is preferably interconnected with the supply conduit 5 leading to the inside of the pallet 7 as indicated in FIG. 1. As more particularly illustrated in FIG. 7, the conduit 27 depicted in FIG. 6 is actually a pair of conduits 27A and 27B, and these two conduits are actually preferably interconnected with the supply conduits 5A and 5B as more particularly illustrated in FIG. 2.

Similarly, the contents of the pallet 7 are interconnected with the inside of the tank 20 by means of the return conduit 6 which is appropriately interconnected with a vent in the top of the tank 20. The gearbox 28 is interconnected with the alternating valve 25 by means of an output shaft 30 from the gearbox 28. The tank 20 is further preferably provided with a heating element 31 which, in turn, may be interconnected with an appropriate supply of electrical power by way of connection 32, in order that the water within the tank 20 may be heated to a suitable temperature.

As hereinbefore indicated, a particular factor in achieving the sought-for massage is the rate at which the streams in tubes 15A-B alternate in flow rate as indicated in FIGS. 3-5. It is the function of the alternating valve 25 in the tank 20 to change the flow rates in lines 10 and 11. Accordingly, the function of the alternating valve 25 is to shift the water entering the valve 25 from the pump 23 between the conduits 27A and 27B, as a function of the speed of the motor 29. Accordingly, control 35 is provided for selectively adjusting the speed of the motor 29, and therefore the speed at which the gearbox 28 and its output shaft 30 change the position of the alternating valve 25.

As also previously stated, the massage which is being provided to the person lying on the sheath 17 of the pallet 7 may also be controlled by adjusting the impact of the stream issuing upwardly from the port 16 illustrated in FIGS. 3-5. This, in turn, may be achieved by adjusting the speed of the motor 24 which drives the pump 23, by means of a suitable control 36 on the opposite side of the tank 20. Thus, the pump 23 accepts and receives water from within the tank 20 through its intake 23A and discharges such water to the alternating valve 25 at a flow rate determined by the speed of the pump motor 24.

Referring now to FIG. 8, there may be seen a more detailed pictorial representation, partly in cross section, of the alternating valve 25 depicted more generally in FIGS. 6 and 7. More particularly, the alternating valve may be seen to be a four-way tubular member having a port for receiving water through the conduit 26, a port interconnected with conduit 27A for discharging such water to line 5A in FIG. 2, and a third port interconnected with conduit 27B for discharging water into conduit 5B as illustrated in FIG. 2. As hereinbefore stated, the alternating valve performs this function in response to rotation of the shaft 30 by the gearbox 28. Accordingly, the four-way tubular housing of the alternating valve 25 is further provided with a fourth outlet for sealingly accepting the free-traveling of the shaft 30 which, in turn, is fixedly connected to the opposite end of a frustro-conical member hereinafter referred to as the shutter 33. The shutter is a cylindrical member having a canted surface 34 confronting the stream of water issuing from the pump 23 through the conduit 26. When the shutter 33 is revolved so that its canted surface 34 is opposite the riser conduit 27B (as illustrated in FIG. 8), the input to riser conduit 27A will be blocked and all flow through conduit 26 will be diverted into riser conduit 27B. Alternatively, when the shaft rotates 180° to revolve the shutter 33 within the four-way tubular housing of valve 25, the canted surface 34 of the shutter 33 will be positioned to divert water from the conduit 26 into the riser conduit 27A, and all flow from 26 will be blocked insofar as riser conduit 27B is concerned.

The effect of revolving the shutter 33 is, of course, to cause water to be alternatively and intermittently or periodically shifted between manifolds 8 and 9 as illustrated in FIGS. 1 and 2, and to thereby cause the output streams from the various nozzles 12 within the apparatus depicted in FIGS. 1 and 2 to massage the person lying upon the pallet 7.

Referring now to FIG. 9, there may be seen apparatus embodying a different alternative form of the present invention, which apparatus may preferably include a different form of massage assembly 38 formed of a rigid box 39 having a rectangular structure mounted thereon and composed of a flexible sheath 40 interconnected with a rectangular frame 40A and a flexible mesh 40B. As may further be seen, the assembly 38 includes a reservoir and pump 4 of the type hereinbefore illustrated in FIGS. 6 and 7, and having a plurality of conduits 46 leading to a pair of manifolds 47 supported within the box 39 by a plurality of lateral brace 48. As further indicated in FIG. 9, the purpose of the box 39 is to contain a quantity of water 42, and therefore the return line 6 preferably extends below the level of the water 42 and into the top of the reservoir and pump assembly 4. As may further be seen in FIG. 9, the two supply conduits 46 (only one being visible in FIG. 9) extend through the frame 40A to interconnect with an appropriate pair (only one visible) of manifolds 47 which, in turn, are arranged to interconnect with a plurality of pairs of lateral lines 49 and 50. Each pair of lateral lines 49 and 50 will, in turn, be provided with a plurality of nozzles 51 of the same design as the nozzle 12 depicted in FIG. 3, and which therefore have outlets for directing oscillating streams of water upwardly against the sheath 40. As further indicated in FIG. 9, the sheath 40 and mesh 40B are preferably arranged to provide an elevated portion 41 as a headrest for the person lying on the sheath 40 to receive a massage according to the function of the illustrated apparatus.

Referring now to FIGS. 10 and 11, there may be seen another different embodiment of the present invention, wherein apparatus is depicted which includes a pallet-like assembly 55 formed of a top and bottom sheath 56 and 57 separated by alternate rows of flexible foam 58 and water 59. Each cavity between alternate quantities of flexible foam 58 may be seen to include a pair of lateral conduits 60 and 61 which, in turn, are interconnected with a plurality of nozzles 62 for directing oscillating streams of water upwardly against the underneath surface of the top sheath 56. As more particularly illustrated in FIG. 11, it may be seen that the lateral conduits 60 are each interconnected with a manifold 65 which, in turn, receives a pressured stream of water from apparatus as hereinafter explained. Similarly, each of the lateral conduits 60 61 is, in turn, connected along the length of a manifold 64 which likewise receives a periodic inflow of water, whereby the nozzles 62 produce the oscillating upward discharge of water as hereinbefore explained. Referring again to FIG. 11, it may be seen that, although both manifolds 64 and 65 are arranged on one side of the pallet-like assembly 55, the return conduit 63 is located along the opposite side with spaced-apart intake ports 66 opening into each space containing water and located between alternative spaced-apart portions of flexible foam 58.

Referring again to FIG. 11, it may be seen that the various nozzles 62 are angularly arranged between the associated lines 60 and 61, in an alternate manner. The purpose of this alternate angular arrangement is to direct the oscillating streams issuing from these nozzles 62 in different directions to achieve a more beneficial massage effect with respect to the person lying on the top sheath 56. Even so, it will also be apparent that the stream issuing from each nozzle 62 will nevertheless be directed in generally the same direction at any one time, and that this may tend to cause the massage assembly 55 to be shifted alternately back and forth along its longitudinal axis. This will not, of course, be a disadvantage if the massage assembly is fixedly positioned on some suitable supporting device such as a table or bed. If it is loosely or slidably supported on the flat surface of a table or the like, however, this may create an unstable situation with the pallet or massage assembly 55 tending to shift alternatively back and forth along its longitudinal axis.

This disadvantage may be seen to be overcome in the structures depicted in the FIGS. 1 and 2 and more particularly by the fact that the pairs of lateral lines 10 and 11 are interconnected alternately of each other between manifolds 8 and 9. In other words, it will be apparent that the jets or streams issuing from the nozzles in one pair of laterals 10 and 11 will be directed in one direction, while the jets or streams issuing from the nozzles in both of the adjacent pairs of laterals 10 and 11 will be directed anguarly and opposite therefrom. In other words, at any one time the jets will all be directed in two different directions so as to offset the recoil which would otherwise result from all jets being directed in a single direction. In the case of the arrangement of nozzles 62 in the apparatus depicted in FIGS. 10 and 11, however, all of the jets will be directed angularly in a common direction, and the only offset is provided by the fact that the pairs of nozzles 62 are tilted in opposite directions with respect to each other.

Referring now to the structuress depicted in FIGS. 12 and 13, there may be seen another different embodiment of the present invention wherein the massage effect is sought to be provided by pulsations in the conduits rather than by means of jets of fluid or water as hereinbefore described. More particularly, the various structures depicted in FIGS. 12 and 13 may be seen to include a massage assembly 70 composed of a reservoir and pumping unit 71 and a complex of flexible conduits including a return manifold 75, and further including two supply manifolds 76 and 77. As further illustrated in FIG. 12, these manifolds 75–77 and the lines extending laterally therefrom, are in a collapsed flattened condition when not being charged or filled with water, and which expand to a rounded configuration when swollen by the input of a pressured stream of water. As previously indicated, the reservoir and pumping unit 71 is intended to supply this pressured stream of water to the manifolds 76 and 77. Accordingly, as indicated in FIGS. 12 and 13, the reservoir and pumping unit 71 is preferably interconnected with manifolds 76 and 77 by means of supply conduits or hoses 73 and 74, respectively, and the return manifold 75 is preferably interconnected with the reservoir and pumping unit 71 by means of a similar return conduit or hose 72.

Referring again to FIGS. 14 and 15, it will be noted that air 102 must be drawn or forced down through the air intake conduit 90, in order to be commingled with water 103 from the pump 87. This may be accomplished by a conventional compressor (not depicted), or it may be achieved by establishing a pressure in the nipple 98 of a magnitude sufficient to create a pressure drop adjacent the outlet end of the air nozzle 100. In such an arrangement, however, it will be noted that the output pressure from the pump 87 must also be great enough to lift the aerated water in the conduits 97 and also in conduits 73–74.

As indicated in FIG. 12, an alternative arrangement may be used to aerate the water being supplied to the pallet-like assembly 70, by employing suitable aerators 83–A–B which are simply interconnected in lines 73–74 immediately proximate the two input manifolds 76–77. In such an arrangement, the aerators 83A–B may simply draw in air from the ambient atmosphere, because the pump 87 is not required to carry the workload required with the arrangement depicted in FIGS. 14 and 15.

Referring now to FIG. 18, there may be seen a more detailed representation of an aerator 83 of the same type as the aerators 83A–B heretofore illustrated in FIG. 12. In particular, the aerator 83 may be seen to be composed of a T-shaped housing 130 with a tubular intake portion 130A for receiving pressured non-aerated water, another intake portion 130B for receiving an input flow of air, and a tubular outlet portion 130C for discharging a blended mixture of air and water. More particularly, it should be noted that the intake portion 130A of the housing 130 is provided with an internal channel or passageway 131 having a relatively small cross sectional area or diameter when compared with the air passage 132 in the intake portion 130B.

The air intake portion 130B of the aerator 83 may be provided with an inflow of air by any suitable means. In the arrangement suggested in FIGS. 12 and 18, however, the air intake 130B may conveniently be open to ambient atmosphere, because water will flow through the passageway and into an annular blending chamber 136 at a relatively high velocity, and will therefore tend to draw air into the blending chamber 136 for intermixture with the water therein. The pressure thereby created in the blending chamber 136, together with the venturi-like configuration of the discharge passage 133 in the outlet portion 130C of the aerator 83, will draw in and commingle air and water to produce aerated water 135 for discharge through the outlet 134 of the aerator 83.

Referring again to FIG. 13, it will be seen that the two supply manifolds 76 and 77 are interconnected by a series of flexible conduits 78, each of which receives an input of water from an intake port 79 in manifold 77 and each of which empties such discharge of water into the return manifold 75. Alternately, such conduits 78 will receive water from a port 80 in the other supply conduit 76, but its discharge end will nevertheless be connected to the supply manifold 75. In this manner, when the reservoir and pumping unit 71 is energized in the manner hereinbefore described with respect to the reservoir and pumping unit 4, half of the hoses 78 will be momentarily swollen by input pressure from the supply manifold 77, while the other half of the hoses 78 will be in a relaxed condition. At an alternate instant, these relaxed hoses 78 will then be momentarily pressured and swollen into a rounded configuration by pressure from the supply manifold 76, while the original half of the hoses 78 will then be relaxed by discharge of their contents into the return manifold 75. It is the cyclic alternate expansion and contraction of these hoses 78 which provides the massaging effect previously sought to be achieved by the oscillating jets issuing from the nozzles 12 illustrated in FIGS. 1–5, for example.

As hereinbefore noted with respect to the embodiment of the present invention which is illustrated in FIGS. 12 and 13, the massaging effect is sought to be provided by the alternate swelling and relaxing of alternate ones of the flexible conduits 78. The massaging effect achieved thereby may be further enhanced by a blending of air in the water being charged through these hoses 78. Referring now to FIG. 14, there may be seen a more detailed illustration of the structures composing the reservoir and pumping unit 71, and wherein there may be seen a suitable structure for achieving an appropriate blending of air in the water being transmitted to the supply manifolds 76 and 77 depicted in FIGS. 12 and 13. More particularly, the reservoir and pumping unit 71 may be seen to include a suitable tank 85 having a shelf 86 for supporting a suitable pump 87 and driving motor 88, and for also supporting a gearbox 93 with its associated motor 94. As indicated, the pump 87 receives water from within the tank 85, and discharges such water through a nipple 98 which, in turn, is interconnected to one side of a suitable blender 89 having its opposite or discharge end interconnected with the alternating valve 96 by another nipple 99. As further indicated, the alternating valve 96 is alternately interconnected with a pair of vertical risers 97 (only one visible in FIG. 14) which, in turn, interconnect by suitable hoses to the supply manifolds 76 and 77 depicted in FIGS. 12 and 13.

As previously stated and illustrated, the hoses 78 and supply manifolds 76–77 are only charged and swollen with water when the pump 87 is energized in the reservoir and pumping unit 71. When the reservoir and pumping unit 71 is not energized, however, the water contents of conduits 76–78 will drain back into the interior of the tank 85, but the water level 92 will never rise to a point above the top of the air intake conduit 90 which extends down into the top of the blender 89. The reason is that, when the pump 87 delivers a flow of water through the blender 89, and therefrom into the alternating valve 96, the blender 89 receives air from within the tank 85 and above the level 92 of the water therein, by way of the air intake conduit 90, to combine such air with the water flowing into the alternating valve 96, and from there on into the manifolds 76 and 77 and flexible conduits 78. Discharge of this aerated water into the conduits 78 will further produce a pulsing and churning effect within these conduits 78 which, in turn, tends to enhance the massaging effect experienced by a person lying prone on top of this particular massage assembly 70. As will further be noted, tank 85 may conveniently be provided with an air vent 105 whereby water may pass into and out of the tank 85 without the need for special pumping apparatus.

Referring now to FIG. 15, there may be seen a more detailed illustration of the structural aspects of the blender 89, which was depicted more generally in FIG. 14, and which may be seen to be composed of a generally T-like housing having one input interconnected with nipple 98, and having its alternate input interconnected with the lower end of the air intake conduit 90. More particularly, the blender 89 may be seen to have its discharge end interconnected with nipple 99. Accordingly, it will be seen that the blender 89 receives non-aerated water 103 from the nipple 98, and that it combines air 102 from the air intake conduit 90 with such non-aerated water 103 to provide a discharge of aerated water 104 into and through the nipple 99. More specifically, it will be seen that the blender 89 further contains an L-shaped air nozzle 100 having one end sealingly interconnected with the lower end of the air intake conduit 90, and having its other end inserted into the receiving end of the nipple 99. Accordingly, it is the flow of non-aerated water 103 through the blender 89, and over the discharge end of the air nozzle 100, which draws in and combines air from the air intake conduit 90 to produce the aerated water 104 flowing into the alternating valve 96.

Referring now to FIG. 16, there may be seen another massage assembly 110 which is another different alternative of the present invention, and which further constitutes or includes a pallet 111 formed of an interlacing arrangement of pressure hoses 112 and 113. More particularly, the pallet 111 may be seen to include a pair of supply manifolds 114 and 115, and a return manifold 116 arranged at right angles to the supply manifolds 114–115. The pressure hoses 112 may each be seen to be connected at one end to the supply manifold 115 and at their opposite ends to various locations along the length of the return manifold 116. Similarly, the other half of the various pressure hoses 113 may be seen to be connected, at one end, to the supply manifold 14 and, at their other ends, to the return manifold 116. It is intended that the various hoses and manifolds composing the pallet 111 shall all be formed of flexible materials, whereby they will lie flat when not connected to a suitable pressuring and charging means such as the reservoir and pumping unit 71 depicted in FIG. 14, but that they will be swollen with water when such reservoir and pumping unit is energized. More particularly, the manifold 114 will be cyclicly charged with water when manifold 115 is not being charged, and manifold 115 will be charged during the intervals when manifold 114 is not being charged. In this manner, all the hoses 112 will be charged while hoses 113 will not be charged, and hoses 113 will be charged during the intervals when hoses 112 will not be charged. In this manner, it is this alternate charging and relaxing of the various hoses 112-113 which will provide the person with the massage experience whenever such person is lying flat on the pallet.

Figure 17:
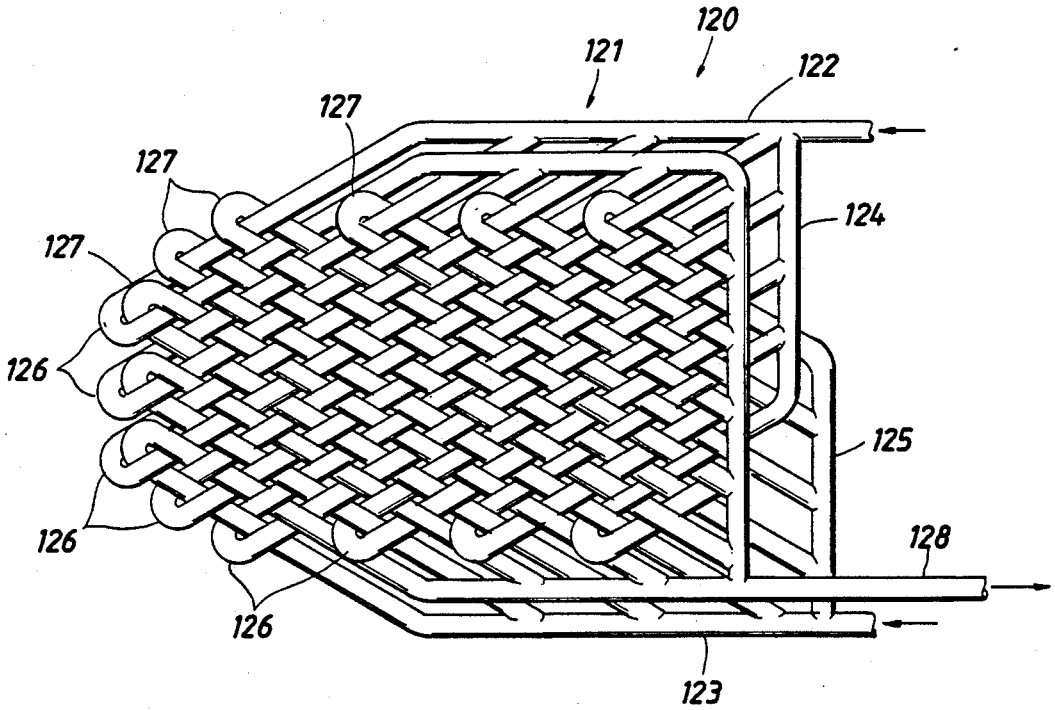
FIG. 17 is a detailed pictorial representation of another different alternative form of the structures depicted in FIG. 13.

Referring now to FIG. 17, there may be seen another variant of the apparatus depicted and described with respect to FIG. 16, and wherein there is a massage assembly 120 having a plurality of conduits interlaced to form a pallet 121 in the same manner as the pallet 111 is depicted in FIG. 16. More particularly, it will be seen that the pallet 121 is also provided with a pair of supply manifolds 122–123, but that manifold 122 is also provided with a lateral extension 124, and that manifold 123 is similarly provided with a lateral extension 125. Accordingly, the pallet 121 may be seen to be formed of interlaced pressure hoses 126–127, wherein the hoses 126 each have one end interconnected with manifold 121, and their opposite ends interconnected with a discharge manifold 128. Similarly, hoses 127 are each arranged and interlaced with hoses 126, whereby one end of each hose 127 is interconnected with either supply manifold 123 or lateral 125, and wherein the opposite ends of hoses 127 are accordingly interconnected with return manifold 128. In this manner, hoses 126 will be pressured into a swollen condition when manifold 122 and lateral 124 are charged with water, and pressure hoses 127 are each caused to be relaxed by the simultaneous relaxation or removal of pressure from within manifold 123 and its associated lateral 125. In alternate cyclic intervals, however, the condition will be reversed whereby a person lying on pallet 121 will experience the equivalent of a massage.

Although all of the various structures hereinbefore discussed and depicted have been designed to massage a person who is in a reclining position, it should be noted that the essential concepts of the present invention may be employed to effectively massage only a selected limited portion of the body. In particular, a wrap-around device embodying the concepts depicted in FIGS. 10–13 may be usefully employed to apply massaging impulses to an arm or leg or other similar portion of the body.

In this regard, it will therefore be apparent from the foregoing remarks that many other variations and alternatives may be employed without departing from the fundamental concept of the present invention. Accordingly, the structures and techniques hereinbefore described and depicted in the accompanying drawings are not intended to be limitations on the scope of the present invention, but are merely intended as illustrations only.

What is claimed is:

1. An apparatus for massage of the human body, said apparatus comprising:

a container adapted to receive a volume of water or other liquid medium therein, said container having at least one wall of flexible liquid impervious sheet material of an areal expanse and configuration suitable for accommodating the human body in reclined position thereon or for supporting a large portion of the human body;

reservoir means for containing a quantity of water or other liquid medium;

first and second piping structures within said container in spaced apart positions therein;

diverter means for alternately connecting said reservoir means in fluid communication with said first and second piping structures;

pumping means operatively associated with said reservoir means and said diverter means for generating and delivering pressured flows of liquid medium from said reservoir means to said first and second piping structures;

a plurality of nozzle means interconnecting with said first and second piping structures and arranged and adapted for directing pressured jet streams of liquid from said first and second piping structures in an oscillating arcuate motion against the flexible wall of said container at locations opposite the surfaces of the flexible wall which yieldably support a person's body reclined thereon whereby a massage of the person's body is effected by the oscillating streams without wetting of the body; and a return conduit means interconnecting said container and said reservoir means for returning an excess of liquid in the container beyond a predetermined amount to the reservoir means.

2. The apparatus as set forth in claim 1 wherein said container is provided with inlet and outlet ports and said diverter means includes first and second supply conduits connecting respectively with said first and second piping structures through one of said ports, said return conduit being connected to said outlet port of said container, and an alternating valve means interconnecting with said pumping means and said first and second conduits for delivering pressured liquid flow to said first and second piping structures in repetitive alternation.

3. The apparatus as set forth in claim 2 wherein said alternating valve means includes a valve housing having an intake port and first and second outlet ports;

means interconnecting the intake port of said valve housing in fluid communication with said pumping means for receiving pressured flow of liquid therefrom;

means interconnecting each of the outlet ports of said valve housing in fluid communication with different ones of said first and second supply conduits;

valve element means including a valve element rotatably positioned in said valve housing for intermittently connecting said intake port with said first and second valve housing outlet ports upon rotation of the valve element; and rotating means for rotating said valve element.

4. The apparatus as set forth in claim 3 further including a first motor means for driving said pumping means, and said rotating means comprises a second motor means for rotating the valve element and control means operatively associated with said second motor means for regulating the frequency and duration of time of each connection of said intake port with each of said first and second outlet ports of said valve housing.

5. The apparatus as set forth in claim 1 wherein said first piping structure in the container comprises a first manifold connecting with one of said first and second supply conduits and a first plurality of distribution conduits wherein each of said distribution conduit interconnects with said first manifold; and said second piping structure comprises a second manifold connecting with a different one of said first and second supply conduits, and a second plurality of distribution conduits, wherein each of said second plurality interconnects with said second manifold, each said distribution conduit of said first plurality being paired with a distribution conduit of said second plurality, and each said nozzle means interconnecting with the two distribution conduits of each said pair.

6. An apparatus as set forth in claim 5 wherein said container is in the form of a pallet having top and bottom walls with the top wall being said flexible wall, said flexible wall being separated from said bottom wall by a corrugated flexible foam structure and alternate rows of liquid filling the grooves formed by the corrugations of the foam structure.

7. An apparatus as set forth in claim 6 wherein said pairs of distribution conduits connecting to said first and second manifolds are disposed in the liquid-filled corrugations of said foam structure, and a third manifold is disposed in said container in fluid communication with said return conduit and said liquid-filled corrugations.

8. An apparatus as set forth in claim 1 wherein said container is in the form of a tank covered by a sheet of liquid impervious material comprising said flexible wall.

9. An apparatus as set forth in claim 5 wherein each said nozzle means is a tubular structure in the form of two tubular sections, each section connected at one end to a different one of a pair of distribution conduits connected respectively to said first and second manifolds and said tubular structure is provided with a nozzle opening at the junction of its two tubular sections, which said opening faces said flexible wall of the container whereby the alternate delivery of pressurized liquid to said manifolds results in imparting an oscillating fan-like motion to the liquid jet stream from each said nozzle opening and in directing said stream against said flexible wall.

* * * * *